US006381928B1

(12) United States Patent
Gregory

(10) Patent No.: US 6,381,928 B1
(45) Date of Patent: May 7, 2002

(54) TAMPER-INDICATING CLOSURE AND CONTAINER PACKAGE

(75) Inventor: James L. Gregory, Toledo, OH (US)

(73) Assignee: Owens-Illinois Closure Inc., Toledo, OH (US)

( * ) Notice: Subject to any disclaimer, the term of this patent is extended or adjusted under 35 U.S.C. 154(b) by 0 days.

(21) Appl. No.: 09/579,684

(22) Filed: May 26, 2000

(51) Int. Cl.[7] ..... B65B 7/28; B65B 43/26
(52) U.S. Cl. ..... 53/468; 53/471; 53/485; 53/381.4
(58) Field of Search ..... 53/468, 471, 485, 53/492, 109, 381.4

(56) References Cited

U.S. PATENT DOCUMENTS

| | | | | |
|---|---|---|---|---|
| 2,339,035 A | * | 1/1944 | Stewart | 53/109 |
| 2,506,363 A | * | 5/1950 | Hohl et al. | 53/109 |
| 2,650,748 A | * | 9/1953 | Bennett | 53/381.4 |
| 3,098,334 A | * | 7/1963 | Barnby | 53/468 |
| 3,682,345 A | | 8/1972 | Baugh | |
| 3,719,023 A | * | 3/1973 | Richardson | 53/381.4 |
| 4,005,799 A | | 2/1977 | Mannaerts | |
| 4,126,240 A | | 11/1978 | Brach | |
| 4,265,071 A | * | 5/1981 | Smith et al. | 53/381.4 |
| 4,346,811 A | | 8/1982 | Hilaire | |
| 4,380,299 A | | 4/1983 | Alejandro Llera | |
| 4,402,418 A | | 9/1983 | Ostrowsky | |
| 4,417,666 A | | 11/1983 | Roberts | |
| 4,418,828 A | | 12/1983 | Wilde et al. | |
| 4,449,639 A | | 5/1984 | Davis | |
| 4,469,234 A | | 9/1984 | Deussen | |
| 4,503,985 A | | 3/1985 | Swartzbaugh et al. | |
| 4,506,795 A | | 3/1985 | Herr | |
| 4,527,704 A | | 7/1985 | Swartzbaugh | |
| 4,546,892 A | | 10/1985 | Couput | |
| 4,687,114 A | | 8/1987 | Crisci | |
| 4,770,308 A | | 9/1988 | Lynn | |
| 4,890,754 A | | 1/1990 | Dorn et al. | |
| 4,903,849 A | | 2/1990 | Wallman | |
| 4,909,404 A | | 3/1990 | Rozenberg | |
| 4,936,474 A | | 6/1990 | Szczesniak et al. | |

(List continued on next page.)

OTHER PUBLICATIONS

1. Two photographs of prior art white container finish. Effective date as prior art unknown.

2. Two photographs of prior art yellow container finish. Effective date as prior art unknown.

3. Two photographs of prior art white container finish. Effective date as prior art unknown.

4. Two photographs of prior art yellow container finish. Effective date as prior art unknown.

*Primary Examiner*—John Sipos

(57) ABSTRACT

A closure and container package that includes a container having a finish with an external thread, and a closure having a base wall and a peripheral skirt with an internal thread for threadably engaging the external thread on the container finish. An internal rib on the skirt extends axially of the skirt between overlapping reaches of the internal thread for frictional engagement with the external thread on the container finish to retard rotation of the closure onto and off of the finish. In the preferred embodiments of the invention, there are diametrically opposed ribs on the internal surface of the peripheral skirt extending between overlapping reaches of the internal thread, with the ribs being of lesser radial thickness than the internal threads. A tamper-indicating band is coupled to the lower edge of the peripheral skirt by frangible bridges for engagement with a bead on the container finish. The closure may be partially applied to the container finish for transport to a packager, with the frangible band on the skirt spaced from the bead on the container, and with the closure held in position on the container finish by frictional engagement between the closure ribs and the external thread on the container finish.

2 Claims, 3 Drawing Sheets

U.S. PATENT DOCUMENTS 5,097,974 A 3/1992 Rozenberg
5,143,235 A 9/1992 Repp
5,145,078 A 9/1992 Hannon et al.
5,197,620 A 3/1993 Gregory
5,292,020 A 3/1994 Narin
5,373,954 A 12/1994 Julian
5,456,375 A 10/1995 May
5,467,880 A 11/1995 Etoh et al.
5,472,106 A 12/1995 Nofer
5,547,092 A 8/1996 Thompson
5,676,270 A 10/1997 Roberts
5,715,959 A 2/1998 Pfefferkorn et al.
5,727,705 A 3/1998 Kelly
5,749,484 A 5/1998 Trout
5,775,527 A 7/1998 Bösl et al.
5,779,075 A 7/1998 Salmon et al.
5,779,076 A 7/1998 Kano
6,123,212 A 9/2000 Russell et al.

* cited by examiner

TAMPER-INDICATING CLOSURE AND CONTAINER PACKAGE

The present invention is directed to a plastic closure and container package and to a method of manufacturing the same, and more particularly to a plastic closure and container package that has a tamper-indicating feature between the closure skirt and the container finish

BACKGROUND AND OBJECTS OF THE INVENTION

It is currently conventional practice in the art of plastic closure and container manufacture to provide a tamper-indicating feature on the closure skirt for engagement with the container finish to indicate that the closure has been removed from the container finish, and thus possible tampering with the closure and container package. U.S. Pat. No. Re 33,265,4,432,461, 5,650,113 and 5,947,311 are cited by way of example. In the manufacture of such packages, the plastic closure and the container are manufactured separately and transported separately to a packager or packaging location, where the container is filled with product and the closure is applied to the container. Separate transport of the closure and the container undesirably increases handling and inventory costs. It is therefore desirable, and a general object of the present invention, to provide a means and method whereby the closure may be assembled to the container prior to transport to the packaging location, thereby to reduce handling and inventory costs. However, it is important to ensure that the coacting tamper-indicating means on the closure and the container finish do not become engaged prior to filling the package, or the closure and/or the entire package must be scrapped.

Is it therefore an object of the present invention to provide a closure and container package in which the closure may be partially assembled to the container finish for transport to the packaging location for disassembly, filling and final assembly of the package by the packager. Another and more specific object of the present invention is to provide a closure and container package in which the closure is affirmatively held on the container finish in a partially assembled condition so as to prevent loosening and potential loss of the closure during transport to the packaging location. Another and more specific object of the present invention is to provide a closure and container package having tamper-indicating means as previously described, in which the closure may be partially assembled to the container finish for transport to the packaging location without engaging the tamper-indicating means on the closure and the container finish. Yet another and more specific object of the present invention is to provide a closure and container package in which the closure is affirmatively but releasably locked to the container finish in a partially assembled position in which the tamper-indicating means are disengaged. Yet another object of the present invention is to provide a closure, a container, and a method of making a closure and container package that fulfill one or more of the objects noted above.

SUMMARY OF THE INVENTION

A closure and container package in accordance with presently preferred embodiments of the invention includes a container having a finish with an external thread, and a closure having a base wall and a peripheral skirt with an internal thread for threadably engaging the external thread on the container finish. An internal rib on the skirt extends axially of the skirt between overlapping reaches of the internal thread for frictional engagement with the external thread on the container finish to retard rotation of the closure onto and off of the finish. In the preferred embodiments of the invention, there are diametrically opposed ribs on the internal surface of the peripheral skirt extending between overlapping reaches of the internal thread, with the ribs being of lesser radial thickness than the internal threads. A tamper-indicating band is coupled to the lower edge of the peripheral skirt by frangible bridges for engagement with a bead on the container finish. The closure may be partially applied to the container finish for transport to a packaging location, with the frangible band on the skirt spaced from the bead on the container, and with the closure held in position on the container finish by frictional engagement between the closure ribs and the external thread on the container finish. In one preferred embodiment of the invention, the external thread on the container finish contains a recess, preferably diametrically opposed recesses, to form a detent locking arrangement for receipt of the internal ribs on the closure skirt. In this embodiment, the skirt is thus releasably locked in position partially assembled to the container finish during transport to the packaging location.

In accordance with another aspect of the present invention, there is provided a method of making a closure and container package by providing a container having a finish with an external thread and an external bead spaced from the thread, and a closure having a base wall, a peripheral skirt with an internal thread, a band frangibly coupled to the end of the skirt and a rib extending axially between adjacent overlapping reaches of the internal thread. The closure is partially applied to the container finish with the rib on the closure engaging the external thread on the container finish to hold the closure in position with the tamper-indicating band on the closure spaced from and disengaged from the bead on the container finish. The package is transported to a packager or a packaging facility, at which the partially applied closure is removed, the container is filled with product, and the closure is then fully applied to the container finish such that the tamper-indicating band on the closure operatively engages the bead on the container finish.

BRIEF DESCRIPTION OF THE DRAWINGS

The invention, together with additional objects, features and advantages thereof, will be best understood from the following description, the appended claims and the accompanying drawings in which:

Detailed Description of Preferred Embodiments

Figure 1:
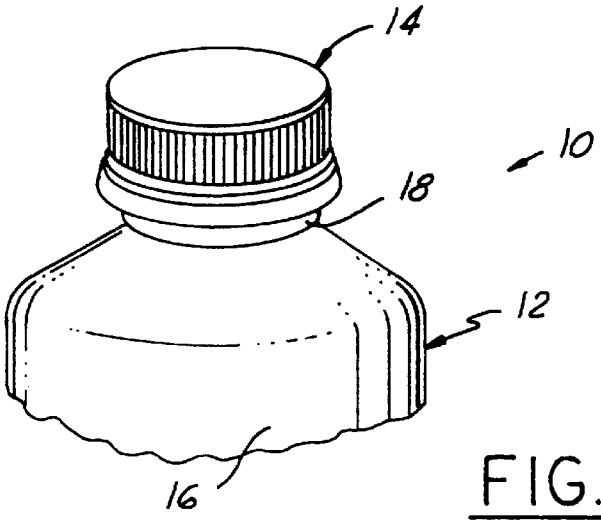
FIG. 1 is a fragmentary perspective view of a closure and container package in accordance with one presently preferred embodiment of the invention.
Figure 2:
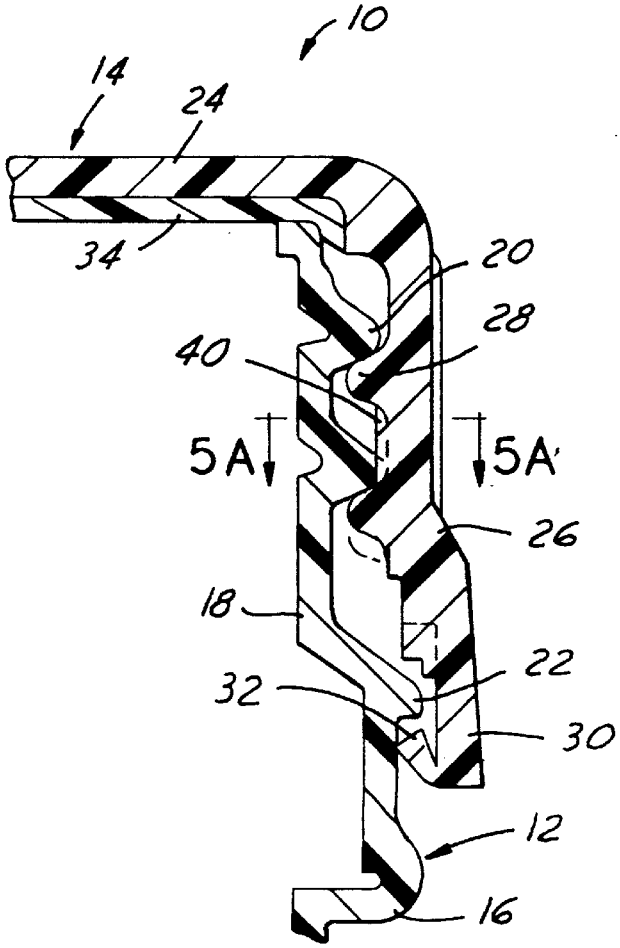
FIG. 2 is a fragmentary sectional view of the fully assembled closure and container package illustrated in FIG. 1.

FIGS. 1–2 illustrate a closure and container package 10 in accordance with one presently preferred embodiment of the invention as comprising a container 12 having a closure 14 threadably received thereon. Container 12 in the illustrated embodiments is a one-piece molded plastic container having a body 16 and a generally cylindrical finish 18 over which closure 14 is received. Glass containers may also be employed. Container finish 18 has one or more external helical threads 20 for receiving closure 14, and a bead 22 spaced beneath thread 20 (in the orientation of FIGS. 1 and 2). Container 12 may be of any suitable composition, such as PET or glass.

Figure 9:
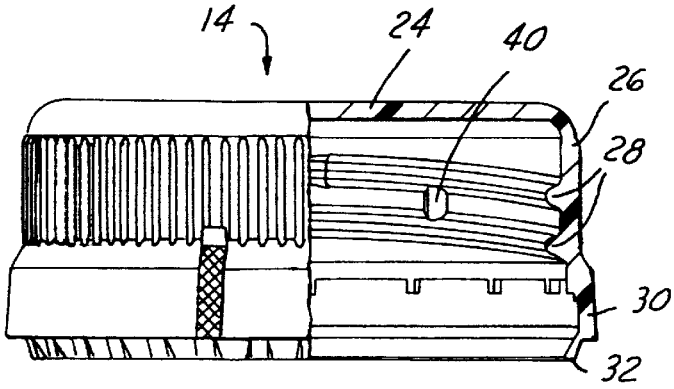
FIG. 9 is a partially sectioned elevational view of the closure of FIGS. 1–8.
Figure 10:
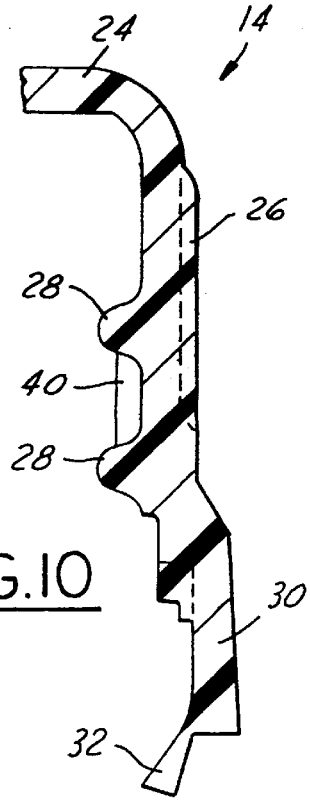
FIG. 10 is a fragmentary sectional view of the closure of FIGS. 1–9.

Closure 14 includes a base wall 24 from which a cylindrical skirt 26 peripherally depends. Skirt 26 has one or more internal helical threads 28 for engagement with external thread 20 on container finish 18. A band 30 is coupled to the lower edge of skirt 26 by a frangible web or frangible bridges, and has a stop flange 32 for abutting engagement with bead 22 on container finish 18. (FIGS. 9 and 10 illustrate flange 32 in the orientation as made, and FIGS. 2–4 and 6 illustrate flange 32 inverted for use.) A liner 34 is positioned on base wall 24 for sealing engagement with the upper edge of container finish 18. Closure 14 may be compression molded or injection molded of suitable plastic composition, such as polypropylene.

Figure 8:
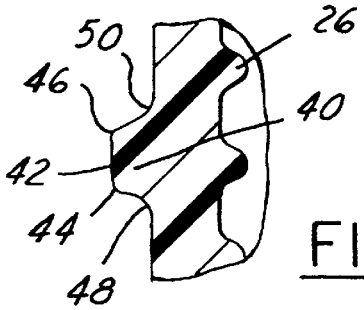
FIG. 8 is a fragmentary sectional view on an enlarged scale of the portion of FIG. 7 within the circle 8.

In accordance with the present invention, at least one rib, and preferably a pair of diametrically opposed ribs 38, 40, extend axially between adjacent or overlapping reaches or portions of internal thread 28 on closure skirt 26. Ribs 38,40 are contiguous with the adjacent reaches of internal thread 28, but are of lesser radial thickness than are the reaches of thread 28. For example, in one preferred embodiment of the invention, thread 28 has a radial thickness of about 0.090 inches, and ribs 38, 40 each have a radial thickness of about 0.24 inches, or about 27% of the radial thickness of the intern thread. Referring to FIG. 8, each rib 38, 40 in this embodiment has a flat internal surface 42 with rounded circumferentially spaced convex corners 44, 46 that blend into the cylindrical inside diameter of skirt 26 by means of concave radiused portions 48, 50. In this embodiment, the total circumferential thickness of ribs 38,40, including surface 42, edges 44, 46 and radiused portions 48, 50, is about 0.080 inches.

Figure 3:
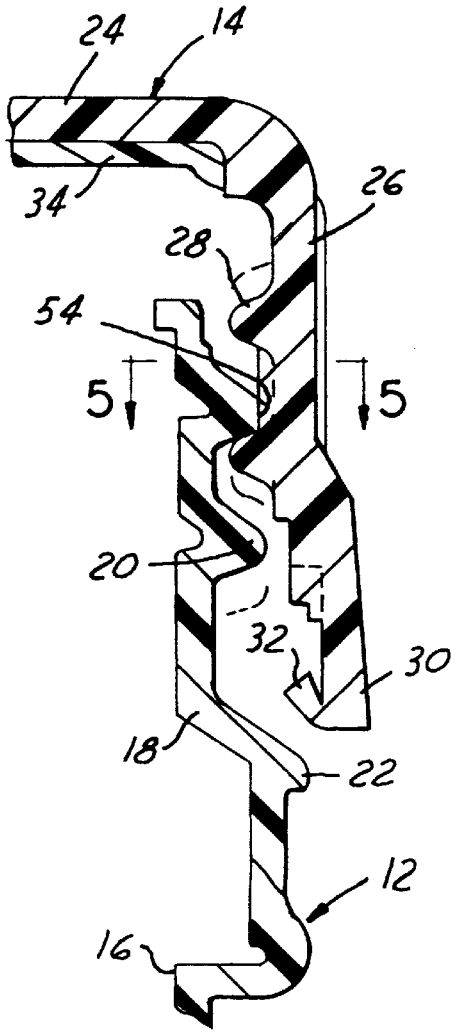
FIGS. 3 and 4 are fragmentary sectional views similar to that of FIG. 2 but showing the closure and container package at respective partially assembled stages.
Figure 4:
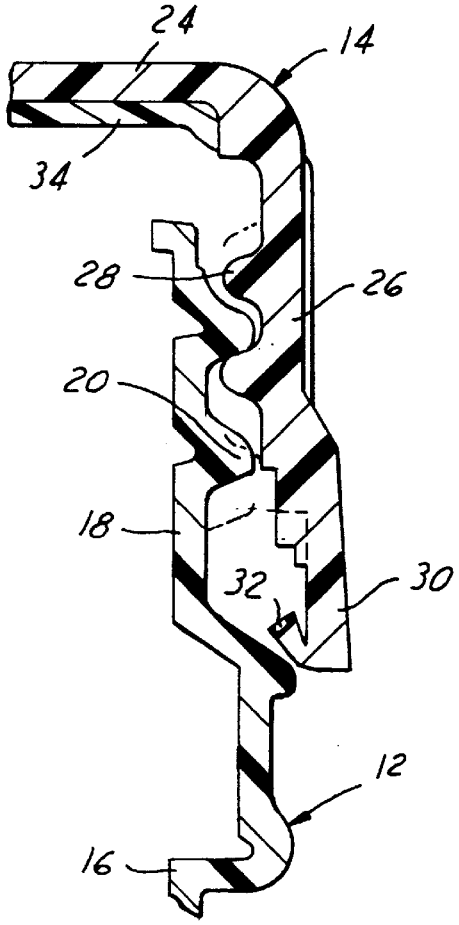
Figure 5:
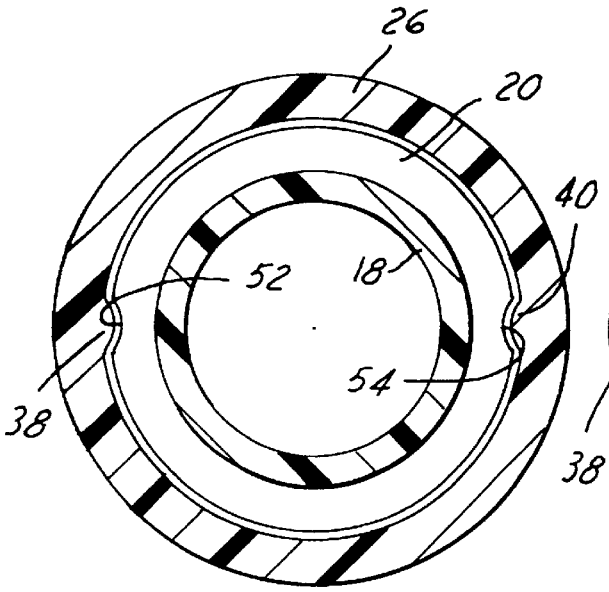
FIG. 5 is a sectional view taken substantially along the line 5—5 in FIG. 3.
Figure 5A:
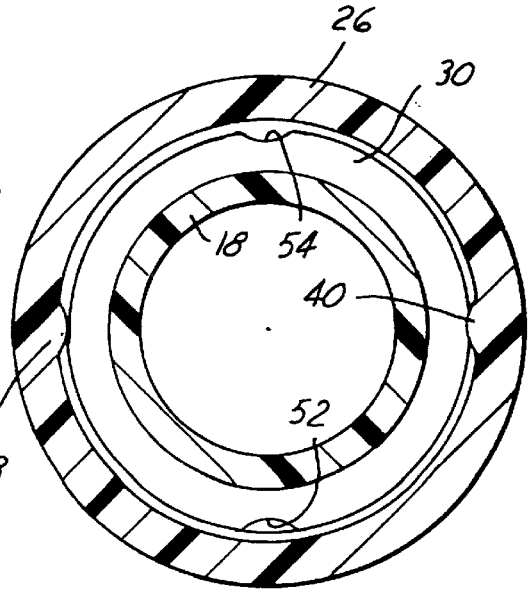
FIG. 5A is a sectional view similar to that of FIG. 5 but taken substantially along the line 5A—5A of FIG. 2.

Returning to FIGS. 1–2 and 5, container finish external thread 20 in this embodiment has a pair of diametrically opposed recesses or pockets 52,54 that releasably receive ribs 38, 40 in the partially assembled position of closure 14 on container 12 illustrated in FIG. 3. In this position, closure 14 is releasably locked to container 12 by means of the detent locking arrangement formed by ribs 38,40 and recesses 52,54, in combination with the radial resiliency of closure skirt 26. Thus, closure 14 is held on container 12 in this partially assembled position, and with tamper-indicating band 30 and flange 32 axially spaced from bead 22 on container finish 18. The partially assembled closure and container package may thus be transported to a packager or packaging station, at which closure 14 may be removed to fill the container. Closure 14 is then reapplied to and through the partially assembled position illustrated in FIG. 3, through the position of FIG. 4 in which tamper-indicating band 30 and flange 32 approach container bead 22, to the fully assembled position of FIG. 2 in which flange 32 is disposed beneath bead 22 and liner 34 is in sealing engagement with the container finish. In this position, as illustrated in FIG. 5A, skirt ribs 38, 40 are circumferentially spaced from finish recessed 52, 54. Recesses 52, 54 have lesser radial thickness than external thread 20.

Figure 6:
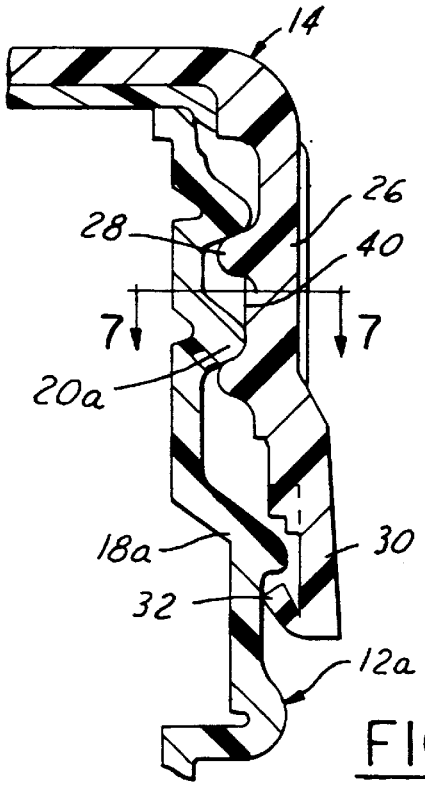
FIG. 6 is a fragmentary sectional view similar to that of FIG. 2 but illustrating a modified embodiment of the invention.
Figure 7:
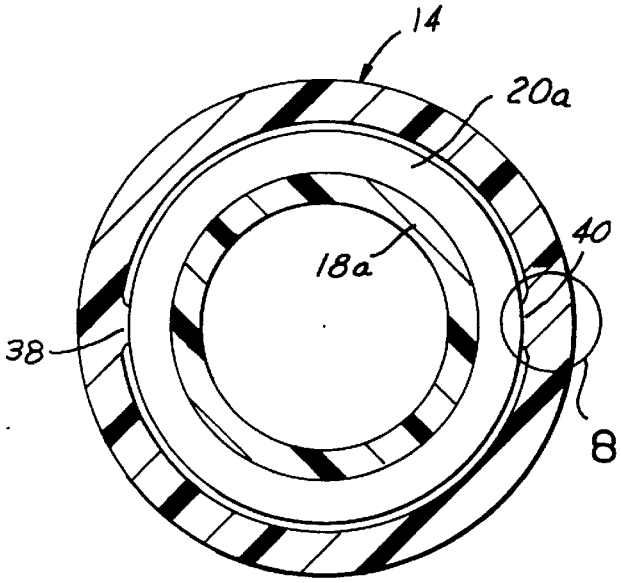
FIG. 7 is a sectional view taken substantially along the line 7—7 in FIG. 6.

FIGS. 6–7 illustrate a modified package 60 in accordance with the present invention, that includes a container 12*a* having a finish 18*a* onto which closure 14 is assembled. As best seen in FIG. 7, external thread 20*a* on container finish 18*a* does not have the recesses or pockets 52, 54 in the embodiment of FIGS. 1–5A. Rather, diametrically opposed ribs 38, 40 of closure 14 are in sliding frictional engagement with the outer diameter surface of finish thread 20*a*. Such frictional engagement holds closure 14 in the partially assembled position during transport. The embodiment of FIGS. 1–5A has the advantage of not relying on frictional contact alone, and of providing a preset locked position between the closure and finish in the partially assembled condition.

There has thus been provided a closure and container package, a closure, a container, and a method of making a closure and container package, that fully satisfy all of the objects and aims previously set forth. Frictional and/or detent locking engagement between the closure and container finish hold the closure in the partially assembled position during transport without engaging the tamper-indicating means on the closure and container. The invention has been described in conjunction with single-thread closures and finishes, but is equally applicable to multiple-thread closures and finishes. The invention has been described in conjunction with two presently preferred embodiments thereof, and a number of modifications and variations have been suggested. Other modifications and variations will suggest themselves to persons of ordinary skill in the art. The invention is intended to embrace all such modifications and variations as fall within the spirit and broad scope of the appended claims.

We claim:

1. A method of making a closure and container package that comprises the steps of:

(a) providing a container having a finish with an external thread and an external bead spaced from said thread, (b) providing a closure having a base wall, a peripheral skirt with an internal thread for threadably engaging said external thread on said container finish, a tamper-indicating band frangibly coupled to an end of said skirt remote from said base wall for engaging said bead on said container finish to indicate tampering with said package, and a rib extending axially of said skirt between adjacent overlapping reaches of said internal thread, (c) partially applying said closure to said container finish with said rib on said closure engaging said external thread on said container finish to hold said closure on said container finish, with said tamper-indicating band on said closure being spaced from and disengaged from said bead on said container finish, (d) transporting said package with said closure partially applied in said step(c), (e) removing the partially applied closure from the container finish, (f) filling the container with product, and then (g) fully applying said closure to said container finish such that said tamper-indicating band on said closure skirt operatively engages said bead on said container finish.

2. The method set forth in claim 1 wherein said step (a) comprises providing a recess in said external thread sized to receive said rib, and wherein said step (C) comprises threading said closure onto said container finish until said rib is received in said recess releasably to lock said closure on said container finish during said step (d).

* * * * *